US005246337A

United States Patent [19]

Boster

[11] Patent Number: 5,246,337

[45] Date of Patent: Sep. 21, 1993

[54] HEAT EXCHANGER WITH HYDROSTATIC BEARING RETURN FLOW GUIDE

[75] Inventor: Clark S. Boster, Whittier, Calif.

[73] Assignee: BW/IP International, Inc., Long Beach, Calif.

[21] Appl. No.: 866,133

[22] Filed: Apr. 9, 1992

[51] Int. Cl.[5] ..... F01D 5/08

[52] U.S. Cl. ..... 415/176; 415/175; 415/177; 165/134.1; 277/22

[58] Field of Search ..... 165/47, 134.1; 415/177, 415/178, 175, 176; 277/22

[56] References Cited

U.S. PATENT DOCUMENTS

| | | | |
|---|---|---|---|
| 3,171,354 | 3/1965 | Sohlemann | 415/175 |
| 3,213,798 | 10/1965 | Carswell | 415/176 |
| 3,620,639 | 11/1971 | Gaffal et al. | 415/175 |
| 3,826,589 | 7/1974 | Frank et al. | 277/22 |
| 4,005,747 | 2/1977 | Ball | 165/134 |
| 4,775,293 | 10/1988 | Boster | 415/180 |

OTHER PUBLICATIONS

Drawing PN-2 "Primary Nuclear Pumps" Welded Rotating Element International Heat Exchanger, Byron Jackson Products, Date Unknown.

*Primary Examiner*—John Rivell
*Assistant Examiner*—L. R. Leo
*Attorney, Agent, or Firm*—Pretty, Schroeder, Brueggemann & Clark

[57] ABSTRACT

A generally cylindrical thermal shield for a heat exchanger in a centrifugal pump which includes a fixed inner diameter vertical wall that forms an annular clearance coaxially around the pump impeller shaft, an outer vertical wall that has a diameter greater than the diameter of the inner vertical wall, and a bottom section that extends upwardly between the inner and outer diameter vertical walls such that the bottom section meets the outer wall at an obtuse angle and meets the inner wall at an acute angle. Such a construction prevents any part of the outer wall from being located opposite the journal return holes of the impeller chamber and minimizes or eliminates erosive wear that may otherwise occur from the flow of fluid from the return holes against the bearing journal.

12 Claims, 4 Drawing Sheets

HEAT EXCHANGER WITH HYDROSTATIC BEARING RETURN FLOW GUIDE

BACKGROUND OF THE INVENTION

1. Field of the Invention

This invention relates generally to heat exchangers for centrifugal pumps and, more particularly, to heat exchanger thermal shields that enclose a heat exchanger that is located within the impeller chamber of a pump.

2. Description of the Related Art

A centrifugal pump generally includes a pump housing and an impeller assembly that attaches to a vertically-oriented pump shaft. The impeller assembly and pump shaft rotate within an impeller chamber in the pump housing. The impeller assembly includes an impeller and a cylindrical bearing journal which rotates relative to the pump housing walls. A cylindrical hydrostatic bearing surrounds the journal and maintains the impeller assembly in position. The pump housing includes passages that allow a flow of product fluid to circulate past the hydrostatic bearing to provide for the bearing function. See, e.g., U.S. Pat. No. 4,775,293 to Boster.

An internal heat exchanger typically is located in the impeller chamber. See, e.g., U.S. Pat. No. 4,005,747 to Ball. The heat exchanger includes concentric baffles that rotate with the pump shaft and includes concentric, cylindrical cup-like portions that fit between the baffles and that are stationary relative to the housing. The product fluid is circulated past annular clearances at the top and bottom of the hydrostatic bearing. At the bottom clearance, the fluid flows through a plurality of journal return holes into the impeller chamber toward the impeller, past the heat exchanger, along the pump shaft, and out the impeller chamber. An external cooling fluid circulates through the cup-like portions and therefore draws off heat in the product fluid. A generally cylindrical thermal shield covers the heat exchanger to attenuate the thermal gradients. The thermal shield is stationary relative to the rotating bearing journal.

After a centrifugal pump with a cylindrical internal heat exchanger has been in use for some time, a groove may be eroded into the inside surface of the bearing journal. This groove can weaken the journal, requiring repair or replacement of the impeller assembly, and, in certain environments, such as nuclear reactors, repair/replacement operation can be very costly.

It is believed that erosion of the bearing journal is caused by the confluence of the upper and lower bearing return flows at or near the heat exchanger's thermal shield. In some pumps, the journal return holes are located directly opposite the thermal shield, which typically has a flat bottom and a generally cylindrical, curved outer wall. Thus, lower bearing return flow from the journal return holes is directed to the corner of the heat exchanger and when combined with the upper bearing return flow causes a turbulent action resulting in secondary flows or vortices which are believed to be a major contributor to erosive patterns found on the inner surface of the bearing journal just above the heat exchanger corner.

From the foregoing discussion, it should be apparent that there is a need for a heat exchanger that reduces turbulence in the flow of fluid within the impeller chamber and minimizes or eliminates the flow from wearing a groove in the bearing journal. The present invention satisfies this need.

SUMMARY OF THE INVENTION

The present invention provides a centrifugal pump heat exchanger having a flow guide or a thermal shield whose outer surface is shaped to reduce turbulence in the flow of product fluid into the impeller chamber such that the flow of fluid from the journal return holes does not meet other impeller chamber flows, such as the downward flow of product fluid from the top of the bearing journal, creating turbulent vortices that might otherwise cause the combined flow to wear or erode a groove on the inner surface of the bearing journal. In this way, the heat exchanger thermal shield ensures that the fluid flows with minimum turbulence past the heat exchanger and minimizes wear on the inside surface of the journal.

Preferably, a heat exchanger in accordance with the present invention includes a thermal shield having a frustoconical bottom surface that tapers upwardly and outwardly and that meets the outer wall of the thermal shield at a point above the journal return holes of the bearing journal. The bottom surface preferably extends outwardly from the inner diameter of the thermal shield to the outer diameter of the thermal shield at approximately a 15–45 degree angle from horizontal. The bottom surface can be a linear surface or can be a compound curve, or a convex or concave surface or a combination of the same. In another aspect of the present invention, the outer surface of the thermal shield may include one or more ribs that further reduces vortices in the flow of product fluid from the journal return holes and that reduces turbulence that otherwise would occur from the upward flow meeting the downward flow in the annulus between the inside surface of the bearing journal and the cylindrical portion of the thermal shield.

Other features and advantages of the present invention should be apparent from the following description of the preferred embodiments, taken in conjunction with the accompanying drawings, which illustrate, by way of example, the principles of the invention.

DESCRIPTION OF THE PREFERRED EMBODIMENTS

Figure 1:
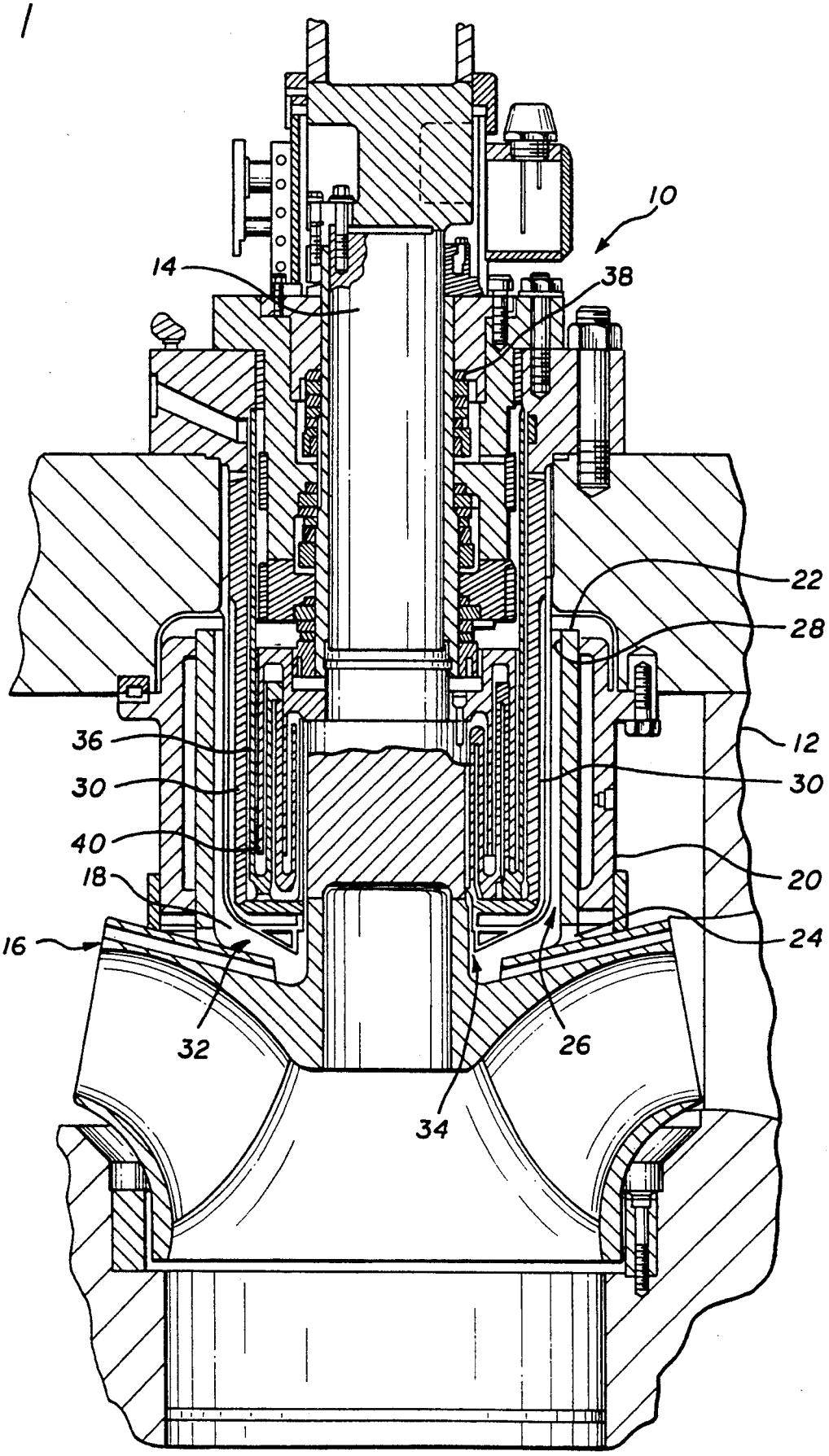
FIG. 1 is a partial sectional view of a preferred embodiment of a centrifugal pump in accordance with the present invention.

With reference now to the illustrative drawings, and particularly to FIG. 1, there is shown a centrifugal pump 10 having a pump housing 12 and a vertically-oriented pump shaft 14, which rotates relative to the housing and to which is attached an impeller assembly 16. The impeller assembly is rotatable within an impeller chamber 18 of the pump housing and is rotatably supported by a hydrostatic bearing 20 and a bearing journal 22. A product fluid flows in the pump housing, around the hydrostatic bearing, and enters the impeller chamber in a radial flow from a plurality of journal return holes 24 near the bottom 26 of the journal and enters the impeller chamber in a downwardly flow from the top edge 28 of the journal. The radial flow and downward flow meet outside the bottom edge of a generally cylindrical heat exchanger assembly 30. A lower outside surface 32 of the heat exchanger assembly has a substantially frustoconical shape, which removes or reduces turbulence where the radial flow and downward flow combine. This, in turn, reduces or eliminates the potential for erosive wear that otherwise may occur on the inner diameter of the journal due to the combined fluid flow striking the journal.

When external seal injection is not being used, a small portion of the product fluid travels upwardly along the pump shaft 14 and past a space 34 between the heat exchanger assembly 30 and the pump shaft and into the heat exchanger assembly. This fluid then flows through inlets (not illustrated) along a first circumferential area of the heat exchanger assembly and between concentric cup-like members 36 that are fixed relative to the housing 12, and exits the heat exchanger assembly through outlets (not illustrated) along a second circumferential area of the heat exchanger assembly. The fluid then continues on toward a mechanical seal assembly 38. The heat exchanger 30 includes concentric baffles 40 that rotate with the pump shaft 14 and that extend downwardly between the cup-like members 36. An externally supplied cooling fluid circulates within the cup-like members and cools the product fluid that flows through the heat exchanger between the baffles and the cup-like members.

Figure 2:
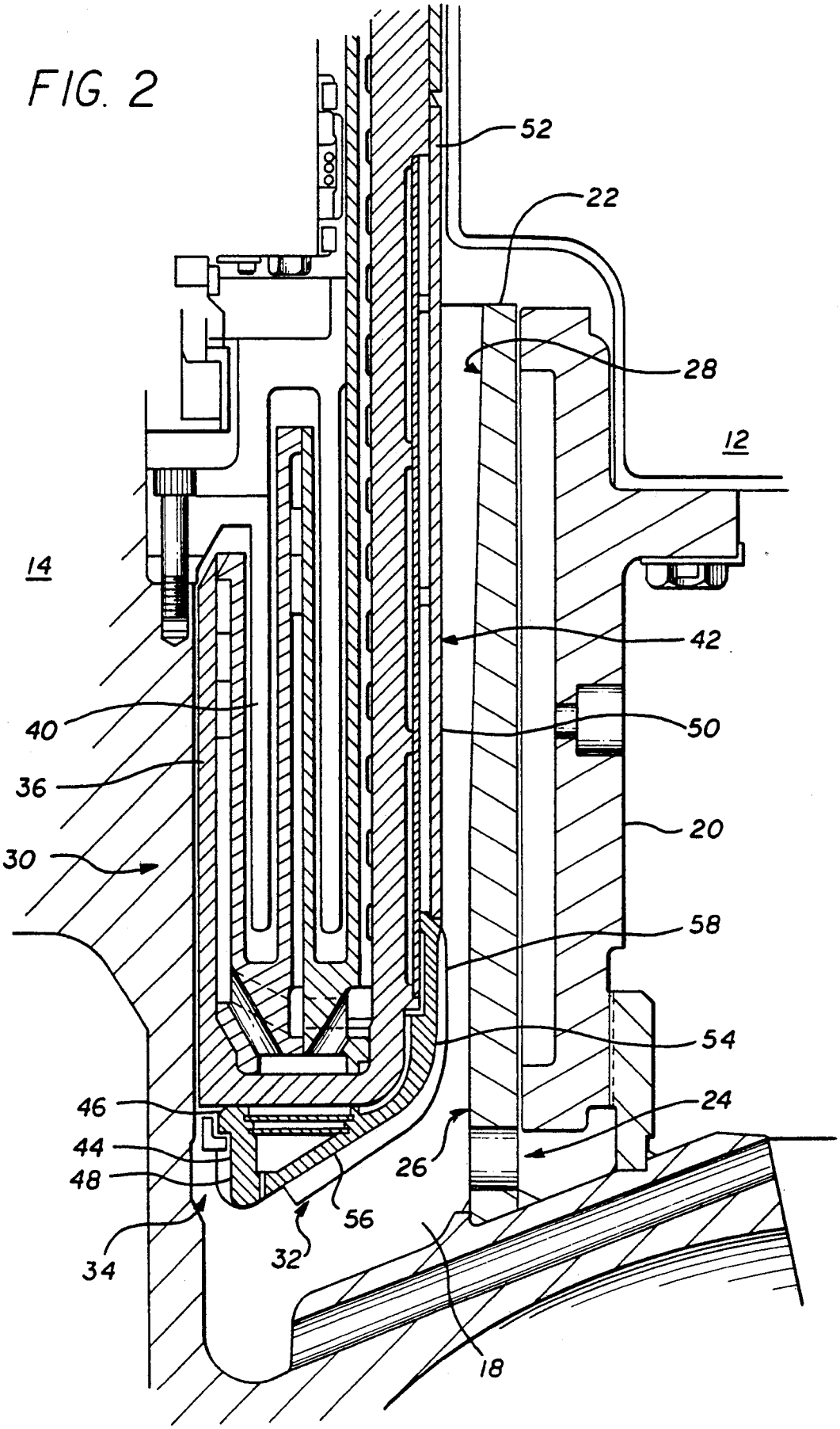
FIG. 2 is a cross-sectional view of the centrifugal pump illustrated in FIG. 1, showing a detail of the heat exchanger and thermal shield.

FIG. 2 shows the heat exchanger assembly 30 illustrated in FIG. 1, in greater detail. The heat exchanger assembly includes a generally cylindrical thermal shield 42 that fits over the cup-like members 36. The thermal shield includes a vertically extending base section 44 having a top edge 46 and a bottom edge 48, a vertically extending outer facing section 50 having a top edge 52 and a bottom edge 54, and a bottom section 56 that extends between the bottom edges of the base section and the outer facing section, and that defines a generally frustoconical surface.

More particularly, the bottom edge 48 of the base section 44 extends farther down the pump shaft 14 than the bottom edge 54 of the outer facing section 50, such that the bottom edge 48 is located in the impeller chamber across from, or generally opposite, the journal return holes 24, and the bottom section 56 extends outwardly and upwardly from the base section to the outer facing section. Preferably, the interior of the thermal shield 42 defines an obtuse angle such that the bottom section 56 and the outer facing section 50 meet at an angle greater than 90 degrees. In the illustrated FIG. 2 embodiment, the bottom section is canted upwardly at an acute angle, at about 25 degrees from horizontal, providing the frustoconical shape which will beneficially direct the flow into the impeller chamber.

The frustoconical shape of the bottom section 56 reduces the turbulence that otherwise generally occurs in this type of pump just above the journal return holes 24 when the flow from the journal return holes mixes with the downward flow of fluid from the top edge 28 of the journal 22. Two aspects of the thermal shield 42 contribute to this beneficial effect. First, the frustoconical shape of the bottom section 56 helps to downwardly deflect the flow from the journal return hole that strikes it. In this way, less of the flow is directed upwardly. Secondly, the bottom edge 54 of the outer facing section 50 is located in the impeller chamber above the journal return holes 24. Therefore, the flow from the journal return holes cannot immediately strike the vertical wall of the outer facing section 50, whereupon some of it would be directed upwardly.

To further reduce the turbulence that is generated in the impeller chamber 18 by the combining fluid flow, the vertical wall of the outer facing section 50 and/or the bottom section 56 can be provided with one or more ribs 58. The ribs are generally arranged axially on the outer facing section and radially on the bottom section. The ribs on the bottom section may be deeper than the ribs on the outer facing section because more room is available in the impeller chamber here. The ribs help break up any turbulence created by the mixing of the flows from the journal return holes 24 and from the top edge 28 of the journal 22.

Figure 3:
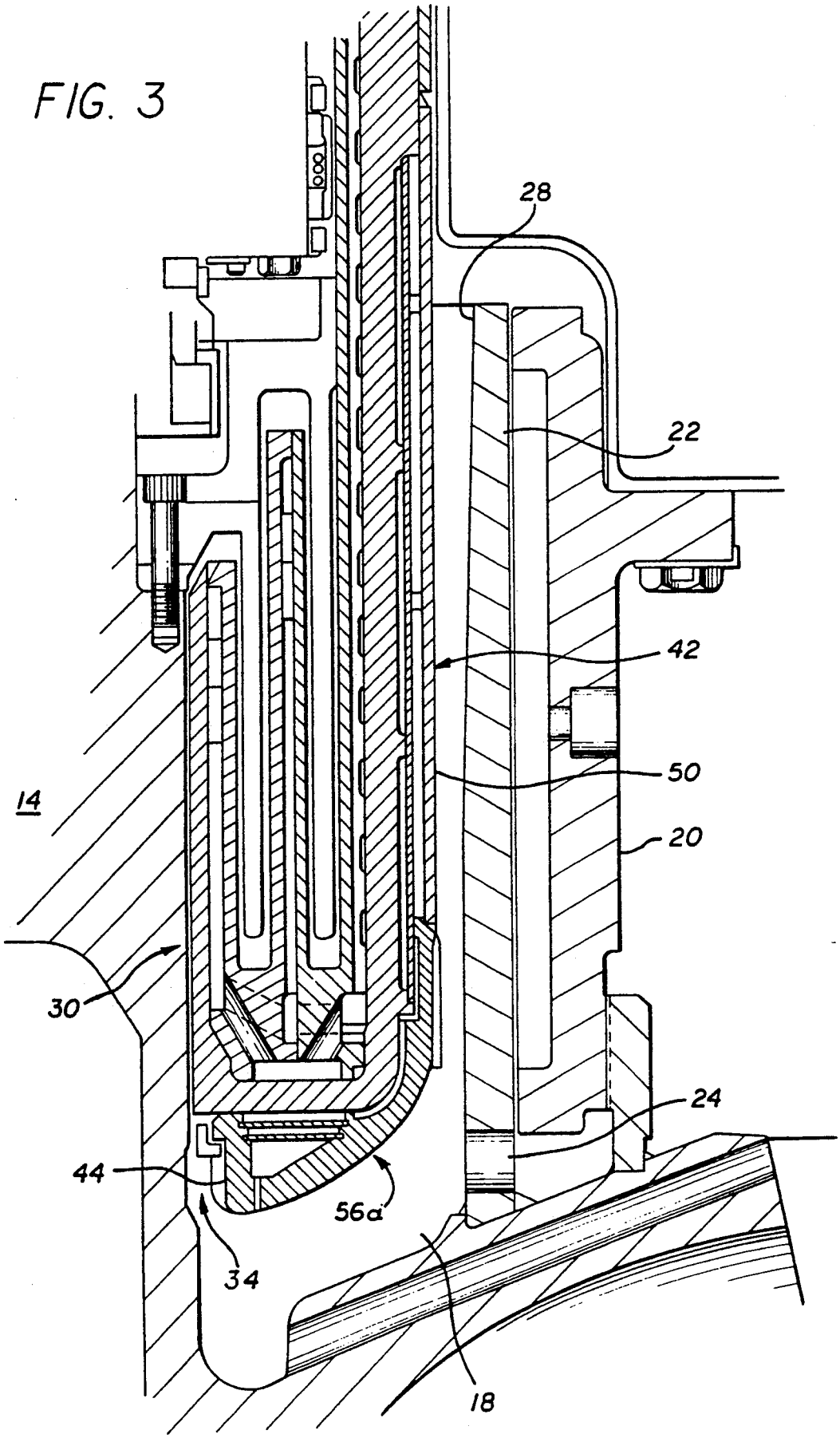
FIG. 3 is a cross-sectional view of a first alternative embodiment of a heat exchanger and thermal shield in accordance with the present invention.

FIG. 3 illustrates another aspect of the invention, in which a bottom section **56*a* of the thermal shield 42 alternatively is provided with a convex shape. The convex shape helps to further deflect the flow of fluid from the journal return holes 24 downwardly and away from the flow coming from the top edge 28 of the journal 22. The outer section 50 can be provided with or without the ribs 58 illustrated in FIG. 2. In either of the embodiments illustrated in FIGS. 2 and 3, the thermal shield 42 reduces turbulence in the impeller chamber and provides a smoother flow of product fluid past the heat exchanger. Moreover, the reduction in fluid flow turbulence minimizes erosion of the bearing journal 22**.

Figure 4:
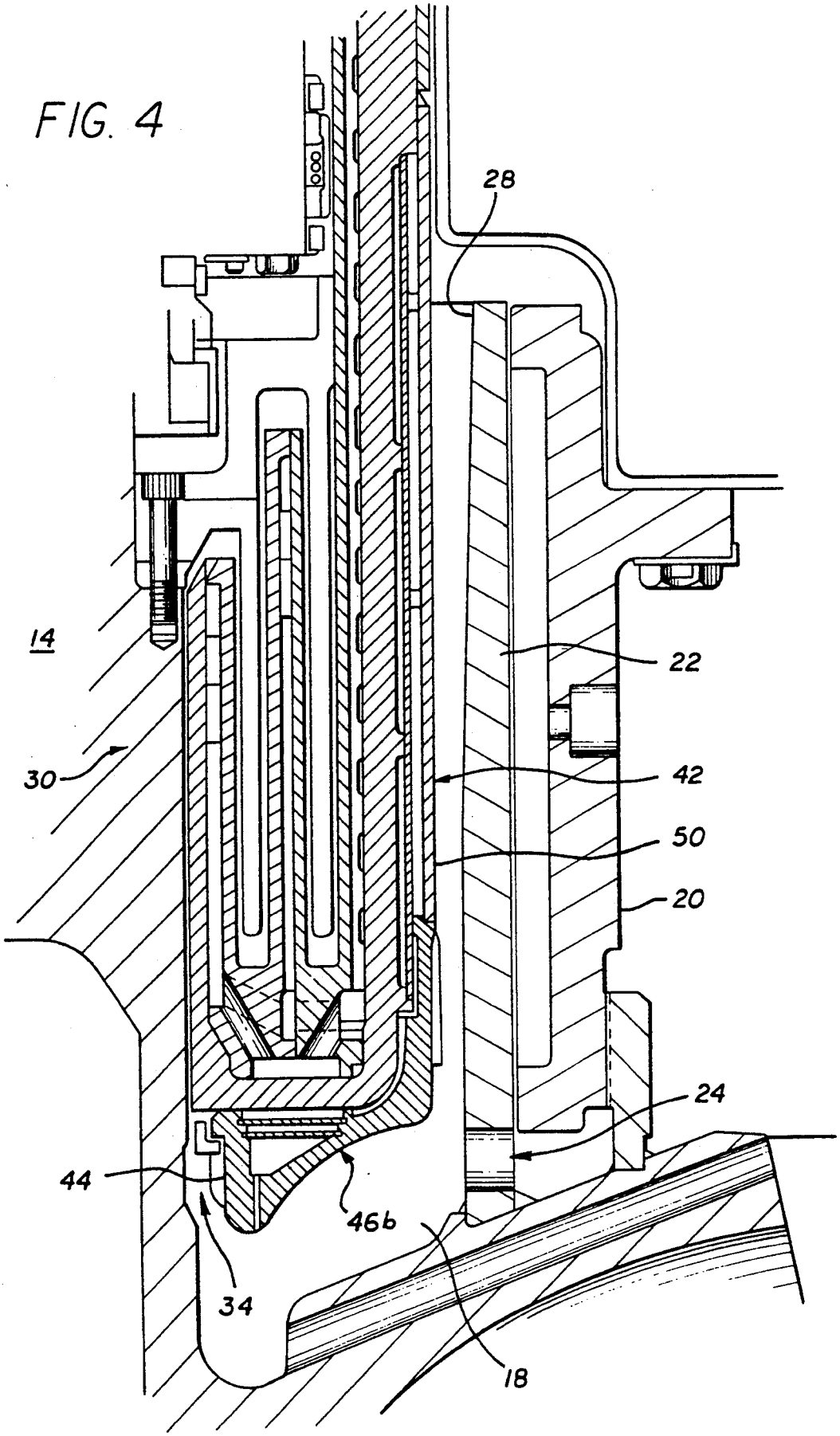
FIG. 4 is a cross-sectional view of a second alternative embodiment of a heat exchanger and thermal shield in accordance with the present invention.

FIG. 4 illustrates another aspect of the invention in which a bottom section **56*b* of the thermal shield 42** alternatively is provided with a concave shape.

From the foregoing, it will be appreciated that the thermal shield in accordance with the invention reduces turbulence that otherwise would occur in the impeller chamber as a result of the combined flows from the journal return hole and from the top edge of the journal bearing, and therefore reduces the possibility of fluid flow in the impeller chamber wearing a groove in the bearing journal. Thus, heat exchangers with thermal shields in accordance with the invention reduce the likelihood of replacement of worn bearing journals.

The present invention has been described above in terms of presently preferred embodiments so that an understanding of the present invention can be conveyed. There are, however, many configurations for heat exchangers not specifically described herein, but with which the present invention is applicable. The present invention should therefore not be seen as limited to the particular embodiments described herein, but rather, it should be understood that the present invention has applicability with respect to internal heat exchangers in a variety of applications. All modifications, variations, or equivalent arrangements that are within the scope of the attached claims should therefore be considered to be within the scope of the invention.

I claim:

1. A centrifugal pump comprising:

a pump housing having an impeller chamber therein;

an impeller assembly disposed in said impeller chamber and having an impeller and a cylindrical bearing journal extending upwardly from said impeller, said journal defining a plurality of generally radially disposed journal return holes for fluid flow;

a rotatable shaft secured to said impeller assembly that rotates with the impeller and bearing journal within the impeller chamber about a longitudinal axis;

a heat exchanger that receives a flow of fluid and that includes a thermal shield that is stationary relative to the bearing journal having a generally cylindrical base section that has a longitudinal axis that is generally coincident with the longitudinal axis of the rotatable shaft and that has a top edge and a bottom edge, a generally cylindrical, outer facing section that extends parallel to the base section, has a diameter greater than the base section, and has a top edge and a bottom edge, and a bottom section that extends from the bottom edge of the base section to the bottom edge of the outer facing section, wherein the bottom edge of the base section is located substantially opposite the journal return holes, the bottom edge of the outer facing section is located substantially above the journal return holes, and the outer facing section and bottom section meet at an angle greater than 90°, defining a frustoconical surface.

2. A thermal shield for a heat exchanger in a centrifugal pump having a pump housing, an impeller assembly including a cylindrical bearing journal that rotates in an impeller chamber of the pump housing and a rotatable impeller shaft secured to the impeller assembly, the impeller chamber receiving a flow of fluid from a plurality of journal return holes in the bearing journal and a flow of fluid from the top of the bearing journal, the heat exchanger thermal shield being stationary relative to the bearing journal and comprising a vertically extending, generally cylindrical inner wall, a bottom section that projects outwardly and upwardly from the bottom of the inner wall at an inner corner and a generally cylindrical outer wall that projects upwardly from the end of the bottom section at an outer corner, such that the inner wall bottom section, and outer wall form an annular cavity that receives the heat exchanger, wherein:

the inner corner is located substantially across the impeller chamber from the journal return holes and the outer corner is located substantially above the journal return holes such that fluid flowing into the impeller chamber from the journal return holes is deflected downwardly by the bottom section.

3. A heat exchanger thermal shield as defined in claim 2, wherein the bottom section is substantially frustoconical.

4. A heat exchanger thermal shield as defined in claim 2, wherein the bottom section extends between the inner corner and the outer corner at an angle between 15 and 45 degrees from horizontal.

5. A heat exchanger thermal shield as defined in claim 2, wherein the bottom section has a convex shape.

6. A heat exchanger thermal shield as defined in claim 2, wherein the bottom section has a concave shape.

7. A heat exchanger thermal shield as defined in claim 2, wherein the outer wall includes at least one rib on its outer surface that reduce vortices in the flow of fluid from the journal return holes.

8. A non-rotatable heat exchanger thermal shield for a centrifugal pump having a pump housing and an impeller assembly, the impeller assembly having an impeller and a cylindrical bearing journal that rotate within an impeller chamber of the pump housing, which receives a flow of fluid from a plurality of journal return holes in the bearing journal and a flow of fluid from the top of the bearing journal, the heat exchanger thermal shield comprising:

a generally cylindrical, vertically extending base section having a top edge and a bottom edge;

a generally cylindrical, outer facing section extending parallel to the base section, having a diameter greater than the base section, and having a top edge and a bottom edge; and a bottom section extending from the bottom edge of the base section to the bottom edge of the outer facing section;

wherein the bottom edge of the vertically extending base section is located in the impeller chamber not higher than the journal return holes, the bottom edge of the outer facing section is located in the impeller chamber substantially above the journal return holes, and the outer facing section and bottom section meet at an angle greater than 90°.

9. A centrifugal pump comprising:

a pump housing having an impeller chamber a rotatable impeller assembly disposed in said impeller chamber and having an impeller and a cylindrical bearing journal extending upwardly from said impeller, said journal defining a plurality of generally radially disposed journal return holes for fluid flow;

a rotatable shaft secured to said impeller assembly that rotates within the impeller chamber about a longitudinal axis;

a heat exchanger that receives a flow of fluid; and a non-rotatable heat exchanger flow guide that receives the heat exchanger and includes a generally cylindrical, vertically extending base section that has a longitudinal axis coincident with the longitudinal axis of the rotatable shaft and that has a top edge and a bottom edge, a generally cylindrical, outer facing section that extends parallel to the base section, has a diameter greater than the base section, and has a top edge and a bottom edge, and a bottom section that extends from the bottom edge of the base section to the bottom edge of the outer facing section, wherein the bottom edge of the base section is located substantially across from the journal return holes in the impeller chamber, the bottom edge of the outer facing section is located substantially above the journal return holes, and the outer facing section and bottom section meet an angle greater than 90°.

10. A heat exchanger for a centrifugal pump having a pump housing and an impeller chamber, with an impeller assembly that rotates within the impeller chamber and with a plurality of journal return holes that allow product fluid to flow into the impeller chamber, the heat exchanger being located in the impeller chamber and comprising:

a plurality of cylindrical, concentric baffles that rotate with the impeller assembly;

a plurality of cylindrical vertical walls that are fixed to the pump housing and that extend between the baffles; and a non-rotatable thermal shield having an inside diameter vertical wall and an outside diameter vertical wall, and a bottom section that extends radially and upwardly from the inside diameter vertical wall to the outside diameter vertical wall such that product fluid flowing into the impeller chamber from the journal return holes is deflected downwardly.

11. A heat exchanger as defined in claim 10, wherein the outer surface of the bottom section is a curved surface.

12. A heat exchanger as defined in claim 10, wherein the outside diameter vertical wall and the bottom section include at least one external rib that reduces the turbulence of fluid striking the bottom section in an upwardly flow in the impeller chamber.

* * * * *